US005538364A

United States Patent [19]

Huntsman

[11] Patent Number: 5,538,364

[45] Date of Patent: Jul. 23, 1996

[54] YIELDABLE MINE POST HAVING A DOUBLE BALL AND SOCKET CONFIGURATION

[76] Inventor: Steven D. Huntsman, 830 S. Skylake Dr., Woodland Hills, Utah 84653

[21] Appl. No.: 389,123

[22] Filed: Feb. 14, 1995

[51] Int. Cl.[6] ..... E21D 15/00

[52] U.S. Cl. ..... 405/288; 405/290; 405/303

[58] Field of Search ..... 405/288, 289; 248/357, 546, 354.1

[56] References Cited

U.S. PATENT DOCUMENTS

| | | | |
|---|---|---|---|
| 1,049,135 | 12/1912 | Nellen . | |
| 1,264,261 | 4/1918 | Blankenship . | |
| 1,653,126 | 12/1927 | Schwerin | 248/357 X |
| 1,848,476 | 3/1932 | Hall . | |
| 2,181,163 | 11/1939 | Akins . | |
| 2,844,348 | 7/1958 | Jordan . | |
| 2,858,694 | 11/1958 | Akins et al. . | |
| 3,171,627 | 3/1965 | Tapley et al. . | |
| 3,250,507 | 5/1966 | Cannon et al. . | |
| 3,289,997 | 12/1966 | Beulker et al. . | |
| 3,309,054 | 3/1967 | Davis-Ratcliffe . | |
| 3,323,771 | 6/1967 | Dowty . | |
| 3,425,656 | 2/1969 | Bore . | |
| 3,437,010 | 4/1969 | Jacobi et al. . | |
| 3,481,573 | 12/1969 | Else et al. . | |
| 3,535,071 | 10/1970 | Bore . | |
| 3,687,443 | 8/1972 | Anderson | 248/357 X |
| 3,737,134 | 6/1973 | Foon . | |
| 3,738,605 | 6/1973 | Smith . | |
| 3,742,662 | 7/1973 | Ballou . | |
| 3,745,772 | 7/1973 | Welzel et al. . | |
| 3,800,546 | 4/1974 | Holken et al. . | |
| 4,004,771 | 1/1977 | Plevak et al. . | |
| 4,249,837 | 2/1981 | Spies . | |
| 4,274,764 | 6/1981 | Curry . | |
| 4,378,180 | 3/1983 | Scott . | |
| 4,382,721 | 5/1983 | King | 405/288 |
| 4,443,134 | 4/1984 | Gross et al. . | |
| 4,718,628 | 1/1988 | Vitta . | |
| 5,015,125 | 5/1991 | Seegmiller . | |
| 5,056,753 | 10/1991 | Lunau et al. . | |
| 5,215,411 | 6/1993 | Seegmiller . | |
| 5,228,810 | 7/1993 | Seegmiller . | |
| 5,314,161 | 5/1994 | Domanski et al. . | |
| 5,342,150 | 8/1994 | Kitchen . | |
| 5,400,994 | 3/1995 | Shawwaf et al. | 405/290 X |

FOREIGN PATENT DOCUMENTS

| | | | |
|---|---|---|---|
| 3340888 | 2/1985 | Germany | 405/290 |
| 688041 | 2/1953 | United Kingdom | 248/548 |

*Primary Examiner*—Dennis L. Taylor

*Attorney, Agent, or Firm*—Bryan A. Geurts; Snow, Christensen and Maritineau

[57] ABSTRACT

A primary mining post, prop, or support that is yieldable to the settling forces of a mine shaft and has a double ball and socket configuration to respond to the shifting that occurs with roof settling in mine shafts. The post has a ball on each end of the main support body and corresponding sockets in each of the respective top and bottom bases. The main body has means for yielding to the heavy weights put thereon.

The double ball and socket configuration allows the heavy weights of a settling subterranean roof to be fully transmitted axially along the length of the main body of the post during off vertical loading without undue buckling and failure. The loading characteristics remain virtually identical with straight vertical and off vertical loading. Traditional supports will buckle and fail under a shifting load since the load forces are distributed differently under a non vertical load.

17 Claims, 2 Drawing Sheets

YIELDABLE MINE POST HAVING A DOUBLE BALL AND SOCKET CONFIGURATION

BACKGROUND OF THE INVENTION

1. Field of the Invention

The invention relates to load bearing support posts generally and more specifically to yieldable mine posts used as permanent primary supports or secondary rehabilitative supports in subterranean cavities. It is applicable and effective for use with any load support application where there are heavy forces involved and the two surfaces being supported may shift relative to one another.

2. Description of the Current State of the Art

In the field of mining, material is removed to form a variety of subterranean cavities. The weight of the material above the cavity has a tendency to settle into the cavity making necessary the use of various types of support props to resist this settling tendency. Two prop categorizations based on longevity of use are permanent and temporary; a permanent prop is designed to be in place the duration of the mining and not reusable while a temporary prop would be removed after a period of time and reused.

Temporary supports are used during the excavation of the cavities that are removed and advanced as the excavation work progresses forward down a mine tunnel. These temporary supports typically have hydraulic actuation of a piston to support the heavy loads. The are not yieldable to the ongoing settling process since they are not designed to be in place for an extended period of time. The present invention deals with the problems associated with permanent, primary, yieldable mine posts as well as secondary rehabilitative supports used to shore up areas where primary supports are failing.

The Bureau of Mines has propagated regulations through the Mining Safety and Health Administration (MSHA) that require primary props be in place prior to actual mining. MSHA categorizes permanent props as primary or secondary props. A secondary or rehabilitative prop is used to control portions of the shaft where settling is not properly compensated by the primary supports already in place.

For long term support of a tunnel structure, permanent support members are put into place and must be yieldable to some extent to the settling process described above. Traditionally, this has been accomplished using stacks of wood. Yieldability is measured as a percentage of total support length. For example, a typical eight foot primary wood support can comfortably yield two feet before failure thereby having a 25% yield factor. The greater the yield factor, the percentage yield before support failure, the more versatile the support. The present invention seeks to significantly increase this yield factor over traditional methods while allowing unparalleled versatility in designing primary supports for a specific application.

Wood has various drawbacks including the considerable bulk involved. The more bulk required for the supports, the greater the excavation necessary for a given shaft to allow movement and ventilation. Another drawback to using timber are environmental concerns stemming from deforestation to supply such large quantities of wood as needed in mining sites. This harms the lodge pole pine forests in the western mines and oak forests in the eastern mines.

Many forms of artificial yieldable posts have been developed to varying degrees of cost effectiveness in comparison with the traditional wood. They also have a number of drawbacks in terms of being bulky, expensive, hard to use, etc. These artificial posts may weigh nearly 200 lbs. and cost upwards of $300 a piece while requiring hydraulic power packs or grease guns to install the supports properly. Examples include variations of concrete cribbing and lava rock pillar as well as a number of metal posts found in the prior art.

Another recognized problem in the area of mining is the shifting associated with subterranean settling. As the roof and the floor of a mine shaft settle, there is a tendency for translational (horizontal in all directions) movement of the either the roof or the ceiling or sometimes both. This translational movement causes shifting in support post bases with respect to one another which in turn causes serious structural integrity problems for support posts unable to accommodate these movements.

The present invention addresses these two major problems found in the mining industry simultaneously. Furthermore, the present invention does so in a less expensive, less bulky, and easier to manipulate fashion than has previously been achieved.

BRIEF SUMMARY AND OBJECTS OF THE INVENTION

The invention is a primary mine support having a double ball and socket configuration to allow translational movement of the bases with respect to one another without buckling or otherwise damaging the structure of the mine support. Current supports are unable to adjust to the shifting that commonly occurs over time in a mine shaft.

As the shifting occurs, ordinary support structures have many forces acting thereon and the main force caused from the settling of the roof towards the floor will not be directed along the length of the support body since it is now at a non-vertical angle. Many resultant forces of the settling force are present and directed at areas of the support unable to resist them. This mainly occurs at the bases of the traditional supports. Structural integrity problems and failure is distributed throughout the support when shifting occurs.

In some cases, the problems associated with shifting requires the addition of secondary supports in order to prevent complete collapse of the tunnel. The invention is also suitable for use as a secondary rehabilitative support.

The double ball and socket configuration features two major contributions that are beneficial in dealing with the shifting problem. The first is the adjustment feature that allows the bases to remain flat and fixed against either the roof or the floor. There is no crimping or binding at the connection between the base and the main body of the support member since the ball is freely movable in the socket within the base. This eliminates a major source of failure found in conventional supports.

The second major advantage or feature provided by the double ball and socket configuration is the ability to effectively transmit the entire force of settling axially along the main body of the support member. In theory, all the forces converge to one point on each of the balls that then transmit the force uniformly along the yieldable support member. In practicality, it is a mating region on the ball and within the socket where the forces are transmitted.

In essence, whether the main body of the support is vertical with respect to the subterranean roof and floor or on an angle because of shifting is immaterial to the support member's ability to function. When off-vertical or otherwise angled, the double ball and socket configuration will keep the full settling force in the identical and optimal alignment as when in the vertical position.

The only changes in force during the entire shifting process is the point or region where the forces are being transmitted through the socket within the base. The forces are always being transmitted through the very end point of the ball though in reality that would be a region.

There are interesting differences in the downward forces in a mine shaft that are not present with a simple load placed atop a support member that make a double ball and socket configuration effective for this application. A load on top of a structure will have a tendency to continue lateral movement more freely than the forces in a mine shaft. This lateral movement, if not stopped, will cause the underlying support to simply topple, even with the double ball and socket configuration explained above. In fact, a double ball and socket configuration, by allowing such free movement, would actually encourage such toppling failure.

In a mine shaft or large building structure, however, the constant downward force of a settling roof has relatively little lateral component. The shifting force or lateral movement occurs slowly and in minute amounts due to the aggregate mass of the roof. It is limited in the amount of translational shifting that may occur and when the shifting does occur, it does so without a disposition to continue in that same direction. In mine tunnels, shifting over time could change directions allowing any number of different shift patterns. A non-vertical angular alignment of the support member bases could eventually right itself.

Under straight vertical loading, a rigid mine post will eventually buckle under the settling load. Likewise, a yieldable mine support will buckle once the full axial yielding length has been traversed. For straight vertical loading, this is true of conventional yieldable supports and the present invention.

The differences become apparent in off-vertical or angled loading where conventional yieldable posts will buckle or fail at the bases long before they have completed their full yield length. Such failures compromise a yieldable post's usefulness and necessitates costly rehabilitation supports to be put in place. The present invention, with the double ball and socket configuration perfectly transmitting the load axially along the main body of the support, will respond exactly as if it were a straight vertical loading situation even when the main body is angled with respect to the bases. The full and effective life is virtually always attained.

For radical shifting, failure may occur in the bases that contain the sockets. The forces present in the base caused by a large angle off vertical due to extensive shifting may allow base failure along the sides of the base. In essence, the end of the ball has a point of contact on the socket that has a vertical component towards the roof (or conversely the floor) and a sideways component against the socket base. The base may break or slide free of the tunnel surface if there is too much of a sideways component. These problems are substantially overcome in the preferred embodiment by choosing materials of sufficient strength to handle the applicable forces for reasonably expected shift rates.

Critical to the proper functioning of the invention is its ability to yield to the ongoing settling pressures in a mine tunnel. This is accomplished in the preferred embodiment by the plastic deformation of a steel tube otherwise known as swaging. This deformation process provides a smooth and predictable yielding to the settling that is desirable and measurable with a scaling means being placed on one member that is stretching and deforming the steel tube. It is important to note that any form of controlled yielding is sufficient and would be considered in harmony with the invention.

It is critical that the element of yielding be present in the implementation of the invention. Otherwise the double ball and socket configuration would provide little benefit other than adjustment. Since the shifting mainly occurs only with the settling, a rigid post with a double ball and socket configuration would buckle long before the benefits derived from the double ball and socket configuration could be realized.

The exemplary embodiment uses a ram tube that fits telescopically into an opening of a load tube. The load tube later tapers to an internal diameter that is less than the external diameter of the ram tube. The ram tube becomes wedged in this taper and the settling force will cause the ram tube to stretch the load tube to a greater diameter as it is forced downward. This stretching produces great amounts of frictional forces that will impede the settling force while yielding to it in a measured and uniform fashion.

Further structure in the exemplary embodiment include balls at the ends of the load tube and the ram tube, the bases containing the sockets and provisions for attachment to the tunnel roof and floor, and a slide tube that fits the interior of the ram tube to prevent internal buckling and keep the ram tube straight with respect to the load tube. Also notable is the placement of a scale on the ram tube for measurement of settling distance and the threaded connection of the balls to their respective tubes that allows adjustment and preloading.

The steel tubing provides greater strength per volume than traditional wood. The simple construction of the various tubes represents a very cost efficient way for providing primary support structures. Because of their small size when compared to traditional timber supports or other yieldable mine supports, the present invention exhibits cost savings in the form of reduced storage, transportation, and excavation costs.

Other benefits over traditional wood cribbing includes the fire and water resistant nature of the support member. The steel used can be polymer coated to resist rust while all materials used can be treated to be more flame resistant than ordinary wood.

The small size of the support member has the added benefit of creating little wind resistance, thereby allowing easier, more efficient, and less expensive ventilation of mine shafts.

Accordingly, it is an object of the invention to provide a primary mining support structure that is yieldable to heavy stresses over a high proportion of the support structure length.

It is another object of the invention to provide a primary mining support structure capable of transmitting all loads axially along the main support body while the base supports are moved off center with respect to each other.

It is a further object of this invention to provide an economical alternative to traditional timber mining support structures.

It is an important object of this invention to allow preloading of the support member between the roof and floor of a mine shaft.

It is yet another object of this invention to provide a less bulky and volume consuming alternative to traditional mining support members.

A featured object of the invention is to provide a means of reliably measuring the amount of settling taking place in a mine shaft.

These and other objects and features of the invention are represented in a preferred embodiment of the invention described below. The present invention in its exemplary embodiment presents a breakthrough in the mining industry. The above mentioned features and advantages as well as others can best be understood from the following specification and drawings, of which the following is a brief description.

BRIEF DESCRIPTION OF THE DRAWINGS

In order that the manner in which the above-recited other advantages and objects of the invention can be appreciated, a more particular description of the invention briefly described above will be rendered by reference to a number of specific embodiments which are illustrated in the appended drawings. Understanding that these drawings depict only typical embodiments of the invention and are not to be considered limiting in scope, the invention will be described and explained with additional specificity and detail through the use of the accompanying drawings in which.

DETAILED DESCRIPTION OF THE INVENTION

This detailed description is based on a commercial device to be used in mine shafts that is designed to begin yielding at 10 tons. Naturally, the parameters of the design can be manipulated to accomplish the objectives required for a particular installation. This exemplary embodiment fully contains all the relevant principles to successfully practice the invention for those skilled in the art.

Figure 1:
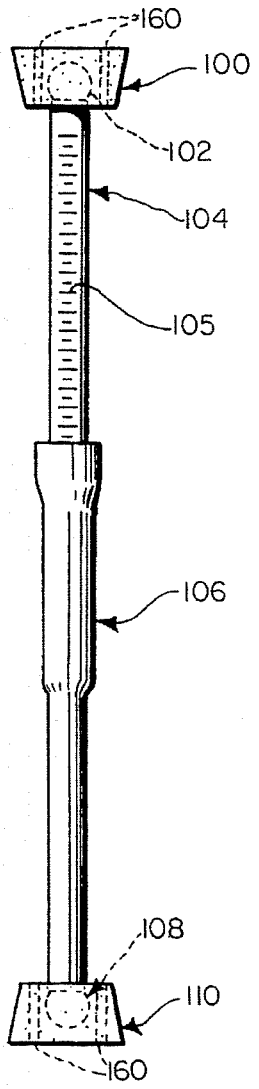
FIG. 1 shows is an isolated view showing the support member in a vertical and loaded position.
Figure 2:
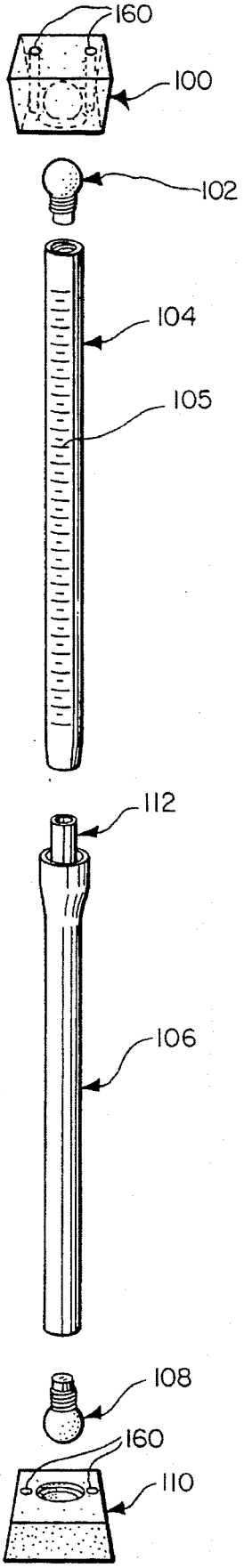
FIG. 2 is an exploded view of the support member showing the various parts.

Referring now to FIGS. 1 and 2, the basic components of the support member are described in detail. The support member comprises the following parts: an upper base 100, a lower base 110, an upper ball unit 102, a lower ball unit 108, a ram tube 104 having a scale 105 thereon, a load tube 106, and a slide tube 112.

Each upper base 100 and lower base 102 is made of a polymer concrete composite have mounting holes 160 for mounting the respective base onto a mounting block. The polymer concrete makes the bases fire resistant and uses flyash instead of cement. The exact composition is 70% rock and sand, 20% resin, and 10% flyash.

Each upper base 100 and lower base 102 is 8" square, weighs 16 lbs. and is capable of supporting 15,000 PSI. Typically, the bases is attached or bonded to wood before placement in a mine shaft though this is not necessary. Furthermore, the rounded socket portion 156 is molded integrally into the base and is designed to accommodate the ball portion 154 of an upper or lower ball unit, 102 or 108 respectively. It is designed so that the ball portion 154 fits evenly within and the surface area between the ball and socket is nearly entirely mated. Once in place, the ball portion 154 will freely move within the socket portion 156.

Having two ball and socket joints, one on the upper base 100 and the other on the lower base 110 allows the full load of the settling force to be transmitted axially along the length of the main body of the support. It is important to note that each ball and socket joint may be of significantly different configuration than is as shown by this exemplary embodiment and still be within the ambit of this invention. The universal joint need not be the same; they could be of different sizes or even different structure as long as they transmit the load axially along the length of the main body of the support.

The ball and socket joint works due to the convex surface of the ball flatly interacting with the concave surface of the socket. This allows universal angular movement while retaining a flat connection for transmitting the forces axially along the support member. Any configuration that substantially transmits forces axially along the support member while simultaneously providing universal angular movement is contemplated by the inventor as part of the invention.

For example, the balls may be part of a base unit and the sockets could be mounted on the main support body; an arrangement that is in reverse of the exemplary embodiment. Another effective alternative would be using disks that are 48" in diameter having a concave surface on the main support length while the bases have a concave dish region of the appropriate diameter to receive the concave disks. The disks would require a substantial mating of surfaces and would not allow as great of movement as the exemplary embodiment illustrated herein. Yet another possibility would entail the use of universal joints similar to those found on automobiles. Those curious and skilled in the art will undoubtedly find ways of combining these and other techniques to successfully transmit forces axially down the length of the support member while simultaneously providing for the angular movement necessary to accommodate the shifting phenomenon.

The upper ball unit 102, in addition to the ball portion 154, has a threaded connection end 150 that screws into corresponding threads in the end of the ram tube 104. The ram tube 104 fits into the load tube 106 and initially slides down until lodging into the load tube tapered portion 141. The yieldable nature of this arrangement will be explained shortly. Attached to the bottom of the load tube 106 by means of a threaded connection end 150 is the lower ball unit 108 that fits into the lower base 110.

Figure 5:
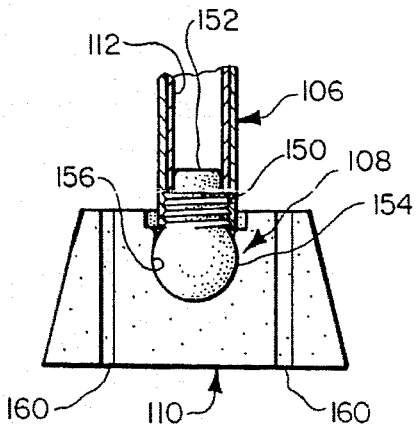
FIG. 5 is a detailed cutaway view of the lower base of the support showing the ball in the socket.

The slide tube 112 fits snugly inside of the ram tube 104 as a stability measure to prevent internal buckling during the swaging process. The lower ball unit 108 has cap portion 152 that fits snugly into the slide tube 112 and holds it in place. FIG. 5 shows the lower ball and socket joint in more detail and is instructive in pertinent parts to show the structure for both of the ball and socket joints.

Note the recessed area 170 about the opening of the socket. A compressible foam ring may be introduced into this recess to assure initial vertical orientation of the support member. By introducing the rings on both ball and socket joints, the support mender can be initially placed at straight vertical. The compressible foam, while able to hold an unloaded socket base in a relatively fixed location with respect to the ball, will easily give way and not be impeded by the high load forces encountered with the shifting associated with the settling process.

Both the upper ball unit 102 and the lower ball unit 108 are identical. They differ only in their orientation, not in their physical structure. This is done for manufacturing efficiency and to reduce total part count for the support member. The ball units are made of a polymer concrete, are coated with an anti-seize lubricant, and are designed to support 15,000 PSI. They are manufactured of the same material mentioned above for the bases. Other materials have been tried such as polyester and epoxy with milled fiberglass that did not yield as desirable characteristics as the polymer concrete described above. Typically, the strength of the polymer concrete components, ball units and bases, is designed so that the bases do not break before the main body of the support fully yields and buckles.

The ram tube 104 is made of steel and is designed and dimensioned according to the application. In a typical mine shaft application, and in this exemplary embodiment, the tube is 39⅜" long, in external diameter, weighs about 16½ lbs., has a wall thickness of 0.218" (A53B steel), and has a 32" scale placed on its exterior surface. The scale allows tracking of settling or vertical compression of the ram tube 104 within the load tube 106. The ram tube 104 also has a tapered portion 144, on the end for engaging the load tube 106, that facilitates the swaging process.

The load tube 106 is also made of steel and can be broken into three distinct regions. The first is the opening with a 4" region that is designed to comfortably accommodate the ram tube 104 in telescoping fashion. This opening region is exaggerated in all of the drawings to clearly show the other aspects of the invention. It ideally would receive the ram tube 104 snugly with the surfaces being in contact.

The next is the narrowing region that transitions the internal diameter of the load tube 106 from greater than or equal to that of the external diameter of the ram tube 104 to less than the external diameter of the ram tube 104. Finally, the rest of the tube has an internal diameter that is less than the external diameter of the ram tube 104 which will be swaged or stretched during the swaging process described in more detail below.

The load tube 106 in this exemplary embodiment is 38½" long in its entirety, is anti-seize lubricated, weighs 11.7 lbs., and has a wall thickness of 0.154" (A106B seamless steel). The main body of the support is the interaction of the ram tube 104 and the load tube 106.

The yieldable qualities of the support structure are derived through the interaction of the ram tube 104 swaging the metal of the load tube 106. The slide tube 112 is used to provide stability to the ram tube 104 during the swaging process. The swaging process is now described in more detail.

Figure 4A:
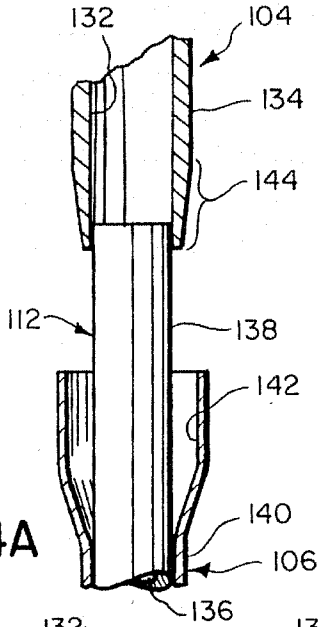
FIGS. 4A and 4B shows the introduction of the telescoping members and the swaging to provide the resistance to settling.

Swaging is the permanent plastic deformation of metal and its implementation in the invention is illustrated in drawing 4A and 4B. In FIG. 4A, the initial placement of the constituent parts is illustrated with the ram tube 104 fitting over the slide tube 112. The external surface of the slide tube 112 fits snugly against the inner surface 132 of the ram tube 104. This allows the slide tube 112 to support the ram tube 104 so as to encourage the load tube 106 to stretch rather than have the ram tube buckle internally.

The use of the slide tube could be eliminated by using a solid member in place of the ram tube 106 or otherwise strengthening the ram tube 106 so that it will not need any support. Eliminating the slide tube 112 would require added means for stability to keep the ram tube 104 properly directed into the load tube. Experimental results have shown that the slide tube is a critical element in preventing buckling about the swage area. If the ram tube 104 is not perfectly aligned with the load tube 106, the support will buckle rather than swage.

The slide tube 112 thus serves to guide the ram tube 104 for proper placement within the load tube 106. It is important that the ram tube 104 fit evenly against the load tube 106 at the narrowing region 141 to properly distribute the forces for swaging. The slide tube may be dispensed with if there is other means for assuring proper placement. Examples of these other placement means would be a snug fit at the opening region along with enough opening region length to assure even placement at the narrowing region 141.

The slide tube 112 as used in this exemplary embodiment is a lightly oiled steel tube that is 40" long, has an external diameter of 1.5", and weighs 12.1 lbs. The internal diameter is such that it fits snugly over the cap portion 152 of the respective ball unit, 102 or 108. Another way of setting the slide tube 112 with respect to the ball units 102 or 108 is to mold the slide tube 112 directly into the ball unit, 102 or 108, during the manufacturing process.

Figure 4B:
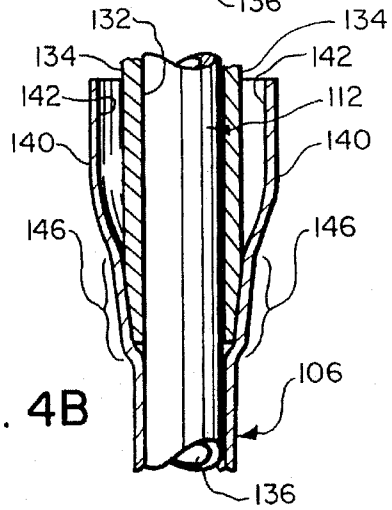

FIG. 4B shows the swaged metal region 146 of the load tube 106. The metal in the swaged metal region 146 is permanently deformed but not split. This is also known in the art as a plastic deformation. This "stretching" provides the constant and predictable resistance to the settling or compression forces that are present axially along the main body of the mine support.

The load characteristics of the support member indicate that the resistance is mainly constant. It will increase, however, as the ram tube 104 is pushed further into the load tube 106 thereby causing a larger swaged metal region 146. This increasing resistance is due to added frictional forces and increases from about 12 tons to about 20 tons over the 2 foot yield length in the exemplary embodiment for yield increase rate of 4 tons per yielded foot.

The resistance is focused in the swaged metal region 146, with tapered end 144 of the ram tube 104 buttressed against the stretching wall of the ram tube 106. The metal's tendency to stay in place provides the significant force against the ram tube 104 to stop or resist its movement. There is only minor frictional interaction involved and high pressure anti-seize lubrication is used to keep the parts freely moving.

Throughout this exemplary embodiment steel circular tubing has been mentioned. Many other structures of tubing could be used effectively. For example, rectangular or triangular shaped tubing could be used. The main functional aspect required for swaging is that the external diameter of the ram tube 104 be greater than the internal diameter of the load tube 106 at a certain point. Therefore, it is the cross sectional dimensions of the load tube and ram tube or ram member that is important for the swaging process. The important element is to cause the load tube to be stretched thereby providing the desired resistance.

Placing the support in a mine shaft is done by the use of an upper mounting block 120 and a lower mounting block 122, both of which are typically made of wood. The mounting blocks are designed so that they will provide a good contact surface with the subterranean surface (usually roof or floor) of the mine shaft. The mounting blocks are not claimed as part of the invention and do not need to be made of wood; any material providing a sure grip onto the subterranean surface and allowing the support member connection would be sufficient. Furthermore, additions or changes to the upper and lower bases, 100 and 110, can be made to achieve substantially the same results.

Figure 3:
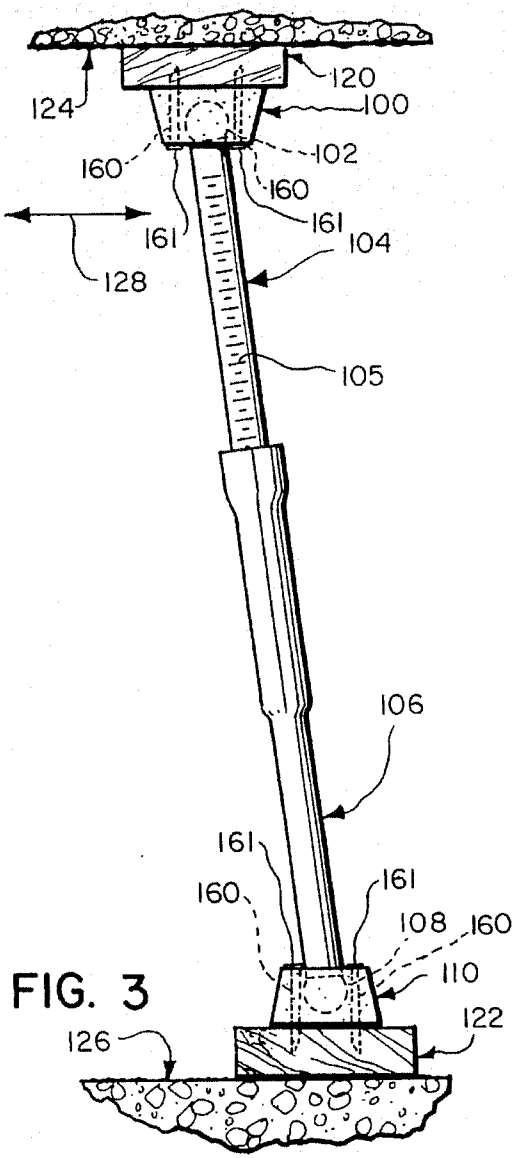
FIG. 3 shows the support as mounted and loaded in a mine shaft with the shifting causing the main body of the support to be off vertical or at an angle. The bases of the support are mounted on a wood planking that interacts with the respective roof and floor of the shaft.

FIG. 3 shows a support member attached to mounting blocks and propping the subterranean roof. The upper mounting block 120 is placed against the subterranean roof 124 and the upper base 100 is held firmly in place by spikes 161 driven through the base mounting holes 160. In like manner, the lower mounting block 122 is placed against the subterranean floor 126 with the lower base 110 also held firmly in place. The support member is also shown as it would appear under a load.

The ability to "preload" a yielding support member is a desirable quality in order to measure the amount of settling taking place. If a mining engineer can measure and track settling characteristics of a mine shaft, precise decisions can be made regarding the addition of support for weakening sections. Rehabilitative supports should be used sparingly.

Preloading can be defined as placing the full load onto the support so as to start the swaging process. When a support member is properly preloaded, any settling will result in an incremental and measurable decrease in the main body of the support due to the compressional forces. If not preloaded, the rock in the roof will tend to break resulting in loads increasing much more rapidly.

Figure 6A:
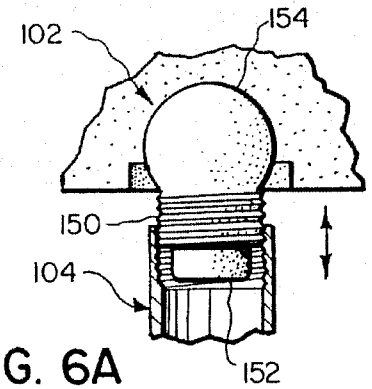
FIGS. 6A and 6B show the adjustment of the support member by way of rotating the individual balls about their respective threaded tubes to get the desired length and/or effectuate preloading.
Figure 6B:
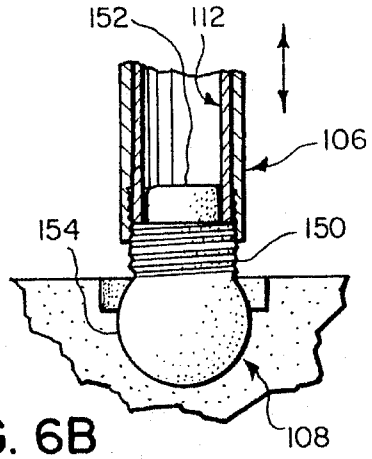

FIGS. 6A and 6B show the preloading facilities according to present invention. Since the respective ball units, 102 or 108, have threaded end portions 150, they may be twisted within the base where they reside to increase the overall length of the main body of the support member. If the length cannot be increased, the load will be placed on the support member. When swaging is started creating a bulge known as the swaged metal region of 146 of the load tube 104, the support member is fully preloaded.

The mating threads used are typically a large thread so as to prevent shearing of the threads due to the intense loads placed on the support. The exemplary embodiment has 1.5 threads per inch and for supports designed to support larger tonnage, greater diameters of the tube components would be advisable as well as a bigger thread such as an Acme ¾" thread.

What is claimed and desired to be secured by United States letters patent is:

1. A load-bearing support member comprising:

(a) an elongated body section having a first end, a second end, and the elongated body section comprising:

i) an elongated ram section of substantially uniform cross sectional dimensions along its length;

ii) an elongated tubular load section having an opening for receiving the ram section, a first portion having an internal cross sectional dimension greater than the external cross sectional dimension of the ram section, a narrowing portion, and a second portion having an internal cross sectional dimension less than the external cross sectional dimension of the ram section; and iii) the ram section telescopically placed into the load section the load section providing resistance as the ram section permanently swages the load section in the narrowing portion;

(b) a first and second base section; and (c) a pair of firs and second universal angular movement means for interconnecting each of the first and second base sections with their respective first and second ends of the elongated body section, the universal angular movement means comprising a convex surface being substantially mated with a concave surface to provide substantially only axial loading along the elongated body section during translational shifting of the base sections with respect to each other.

2. A support member as in claim 1 wherein each interconnection means convex surface is a ball and each interconnection means concave surface is a socket.

3. A support member as in claim 2 wherein each ball is connected to the respective end of the elongated body section and each socket is part of the respective base.

4. A support member as in claim 1 wherein the ram section is tubular, having an internal surface, and the elongated body section further comprises an elongated slide section having an external cross sectional dimension that is slidably engaged with the internal surface of the tubular ram section and with the internal surface of the second portion of the tubular load section to prevent buckling under a load.

5. A support mender as in claim 4 wherein the elongated body section further comprises a means for measuring axial compression and load of the ram section into the load section.

6. A support member as in claim 5 wherein the measurement means is a scale placed on the ram section.

7. A support member as in claim 4 wherein the support member further comprises a means for pre-loading the elongated body section.

8. A support member as in claim 7 wherein at least one of the balls is connected to its respective end of the elongated body section by means of a threaded connector that will effectively adjust the length of the elongated body section.

9. A load-bearing subterranean support member comprising:

(a) a first base adaptable for placement against a subterranean surface and having a socket for receiving a sphere;

(b) a first ball having a spherical end and a connection end, the spherical end placed in the first base socket;

(c) a first circular ram tube having a substantially uniform diameter, a connection end, and an engagement end, the connection end attached to the first ball connection end;

(d) a second circular load tube having an opening and first portion for telescoping reception of the first circular ram tube, and a second portion having a smaller internal diameter than the external diameter of the first circular ram tube to provide resistance to compressional forces, and a connection end;

e) a third circular slide tube to slidingly engage the internal surface of the first circular ram tube and the internal surface of the second portion of the second circular load tube thereby providing added stability;

a second ball having a spherical end and a connection end, the connection end attached to the connection end of the second circular load tube; and a second base adaptable for placement against a subterranean surface and having a socket for receiving a sphere, the spherical end of the second ball being placed in the second base socket.

10. A subterranean support member as in claim 9 wherein a scale is placed on the first circular ram tube to allow measurement of support compression.

11. A subterranean support member as in claim 9 wherein the attachment of the first ball to the first circular ram tube and the attachment of the second ball to the second circular load tube is accomplished by corresponding threads so as to allow adjustment and pre-loading of the support member.

12. A load-bearing subterranean support member comprising:

(a) a ram tube section having internal and external cross sectional dimensions and surfaces;

(b) a load tube section having internal and external cross sectional dimensions and surfaces, the load tube section comprising i) a first portion having an internal cross sectional dimension that will telescopically receive the external cross sectional dimension of the ram tube, ii) a narrowing region where the internal cross sectional dimension narrows to a cross sectional dimension that is less than the external cross sectional dimension of the ram tube to provide a region or plastic deformation of the load tube section and for constant yielding resistance when large axial forces drive the telescopically engaged ram tube section and load tube section together, the narrowing region changing its relative position on the load tube section as the ram tube section deforms the load tube section, and iii) a second portion that has a cross sectional dimension that is smaller than the external cross sectional dimension of the ram tube; and (c) a sliding stability member that telescopically engages the internal surface of the load tube second portion and the internal surface of the ram tube to provide stability and prevent buckling.

13. A load-bearing subterranean support member as in claim 12 wherein the sliding stability member is substantially solid.

14. A load-bearing subterranean support member as in claim 12 further comprising a means for measuring the amount of axial compression.

15. A load-bearing member comprising:

(a) a ram tube section having internal and external cross sectional dimensions and surfaces;

(b) a load tube section having internal and external cross sectional dimensions and surfaces, the load tube section comprising i) a first portion having an internal cross sectional dimension that will telescopically receive the external cross sectional dimension of the ram tube, ii) a narrowing region where the internal cross sectional dimension narrows to a cross sectional dimension that is less than the external cross sectional dimension of the ram tube to provide a region for plastic deformation of the load tube section and for constant yielding resistance when large axial forces drive the telescopically engaged ram tube section and load tube section together, the narrowing region changing its relative position on the load tube section as the ram tube section deforms the load tube section, and iii) a second portion that has a cross sectional dimension that is smaller than the external cross sectional dimension of the ram tube; and (c) a sliding stability member that telescopically engages the internal surface of the load tube second portion and the internal surface of the ram tube to provide stability and prevent buckling.

16. A load-bearing member as in claim 15 wherein the sliding stability member is substantially solid.

17. A load-bearing member as in claim 15 further comprising a means for measuring the amount of axial compression.

* * * * *